US012275564B2

(12) United States Patent
Phung et al.

(10) Patent No.: US 12,275,564 B2
(45) Date of Patent: Apr. 15, 2025

(54) WEDGE SHAPED CONTAINER AND METHOD FOR MAKING A WEDGE SHAPED CONTAINER

(71) Applicant: PROAMPAC HOLDINGS INC., Cincinnati, OH (US)

(72) Inventors: Quang Phung, London (GB); Hui-Yi Wang, London (GB)

(73) Assignee: PROAMPAC HOLDINGS INC., Cincinnati, OH (US)

( * ) Notice: Subject to any disclaimer, the term of this patent is extended or adjusted under 35 U.S.C. 154(b) by 0 days.

(21) Appl. No.: 18/098,310

(22) Filed: Jan. 18, 2023

(65) Prior Publication Data

US 2023/0150715 A1 May 18, 2023

Related U.S. Application Data

(63) Continuation of application No. PCT/GB2021/051813, filed on Jul. 14, 2021.

(30) Foreign Application Priority Data

Jul. 23, 2020 (GB) ..... 2011436

(51) Int. Cl.
*B65D 5/20* (2006.01)
*B65D 5/28* (2006.01)
*B65D 5/56* (2006.01)

(52) U.S. Cl.
CPC ..... *B65D 5/2042* (2013.01); *B65D 5/28* (2013.01); *B65D 5/566* (2013.01)

(58) Field of Classification Search
CPC ..... B65D 5/2042; B65D 5/28; B65D 5/566; B65D 5/208; B65D 5/563; B65D 5/20;
(Continued)

(56) References Cited

U.S. PATENT DOCUMENTS 1,933,643 A 11/1933 Tanner
2,349,589 A * 5/1944 Harrington ..... B65D 5/2061 229/152
(Continued)

FOREIGN PATENT DOCUMENTS

EP 2057076 B1 4/2011
GB 2577061 A 3/2020
(Continued)

OTHER PUBLICATIONS

International Search Report and Written Opinion dated Nov. 9, 2021 received in PCT/GB2021/051813.

*Primary Examiner* — Christopher R Demeree
(74) *Attorney, Agent, or Firm* — McLane Middleton, Professional Association

(57) ABSTRACT

A wedge shaped container formed from a folded web of flexible material. The container comprises a base (1), a rear wall (2) connected to the base, and a pair of upstanding side walls decreasing in height from the rear wall to the opposite end of the base. Each side wall is formed of two side wall panels (4, 6) connected at an edge of the base and connected by a hinge joint. From a fold-flat configuration, folding of the rear wall (2) away from the base (1) causes the side wall panels (4, 6) to be folded inwardly into the erected configuration. The container may have an integral lid (8). The invention also extends to a method of making a blank using a sequence of cuts to create unsupported file regions.

13 Claims, 7 Drawing Sheets

(58) Field of Classification Search
CPC ..... B65D 5/56; B65D 5/4204; B65D 5/2028; B65D 5/4279; B65D 5/2057; B65D 5/2061; B65D 5/36
USPC ..... 229/115, 117.01, 108.1, 117.07, 162.1; 206/776, 395; 220/810
See application file for complete search history.

(56) References Cited

U.S. PATENT DOCUMENTS

| | | | | | |
|---|---|---|---|---|---|
| 2,913,161 | A | | 11/1959 | Travis | |
| 3,006,527 | A | * | 10/1961 | Lofquist, Jr. | B65D 5/18 229/115 |
| 3,653,576 | A | * | 4/1972 | Stranicky | B65D 5/2076 229/122 |
| 5,325,960 | A | * | 7/1994 | Sims | B65D 5/4204 229/115 |
| 7,143,930 | B2 | * | 12/2006 | Money | B65D 5/2028 229/906 |
| 11,140,915 | B2 | * | 10/2021 | Haddad | B65D 5/241 |
| 2010/0019020 | A1 | * | 1/2010 | Phung | B65D 5/4204 229/162.1 |
| 2023/0150716 | A1 | | 5/2023 | Phung | |

FOREIGN PATENT DOCUMENTS

| | | | |
|---|---|---|---|
| GB | 2599068 | A | 3/2022 |
| WO | 2022018410 | A1 | 1/2022 |

* cited by examiner

WEDGE SHAPED CONTAINER AND METHOD FOR MAKING A WEDGE SHAPED CONTAINER

CROSS-REFERENCE TO RELATED APPLICATIONS

This application is a continuation of currently pending international application no. PCT/GB2021/051813 having an international filing date of Jul. 14, 2021 and designating the United States, the international application claiming the right of priority based upon prior filed United Kingdom application no. GB2011436.9, filed Jul. 23, 2020. The entire contents of the aforesaid international application and the aforesaid United Kingdom application are incorporated herein by reference in their entireties.

BACKGROUND

The present invention is directed to a wedge shaped container and a method of making a wedge shaped container. Such a container is intended to contain a wedge shaped product and is primarily intended for packaging cheese. However, it could be used for any suitably shaped item such as a slice of cake.

Wedges of cheese may be wrapped at the point of sale in cheese paper. However, for high volumes of cheese which are sold, for example, by supermarkets these are wrapped in plastic. This can be done in a number of ways. One possibility is a vacuum formed plastic tray, which is sealed with a film. Alternatively, plastic film is sealed around the cheese. A sticker is typically placed on the pack with the necessary product information.

It is known to have an outer packaging made of card, but this is done to present the product information in a more aesthetically pleasing manner than a sticker. The cheese itself will be retained in plastic in the usual way.

The use of plastic packaging is highly successful as it is lightweight and economical, while the properties of the plastic film can be selected to seal the cheese or to allow the cheese to "breathe" and can thus be tailored with the requirements of different cheeses.

However, the use of plastic is undesirable from an environmental point of view.

The present invention provides a new type of pack for a wedge shaped product, which has the potential to reduce the amount of plastic required in the packaging.

SUMMARY

According to the present invention, a wedge shaped container is provided according to claim 1.

The present invention provides a wedge shaped container which is formed by a folding a web of flexible material. The container is simple to produce as it can be created by being cut from a web of material and formed using simple folding and bonding techniques.

Further, it has a fold-flat configuration from which it can be pulled into the erected configuration simply by pulling the rear wall away from the base about the first fold line. This allows the containers to be transported and stored in the fold-flat configuration which allows for a much more efficient use of space than transporting and storing erected containers. The container is well suited to mass production techniques as it can be fed into a packaging machine in the fold-flat configuration and erected by pulling base away from the rear wall and placing the container in a suitable recess.

Further, the use of a folded web of flexible material in this way allows the plastic to be reduced or eliminated depending upon the application.

In its simplest form, the wedged shaped container may be used in an open configuration. This may be used for, for example, for serving slices of cake which are intended to be consumed immediately.

Other applications will require the container to be closed. This may be done by applying a film across the open face of the container. Alternatively, a separate lid may be provided.

Preferably, however, the container further comprises a lid connected at a fourth fold line at an edge of the rear wall opposite to the first fold line, the lid being foldable about the fourth fold line to close the wedge shaped container. The lid may alternatively be connected to the end of the base opposite to the rear wall, or to some other part of the blank such that it can fold over and close the container.

Such an integral lid provides the benefit that the pack can be provided as a single piece. Further, it can be precisely placed onto the open face of the container. The integral lid also combines well with the fold-flat configuration in that, in the fold-flat configuration, the lid simply provides a continuation of the rear wall and will overlie the base.

Further, the use of lid will ensure the structural integrity of the erected container as it will prevent the side wall panels from folding back down into the flat configuration. In the absence of a lid, it may be necessary to separately secure the first and second side wall panels in the erected configuration.

The lid may be held in place in the closed configuration for example, by a tab on the lid or base engaging with a slot in the other of the lid or base. However, preferably, the container has first out turned flanges along the edges of the respective side walls opposite to the base and a second out turned flange at the opposite end of the base. The flanges may just provide rigidity to the container, but preferably the film or lid is bondable to the flanges to close the container.

This provides a more secure connection for the lid which, depending upon material choices, also allows the possibility of creating a sealed container.

In terms of the material choice, the web of flexible material may be plastic free. For example, it may simply be made of an uncoated card. This may be appropriate for items which are intended for immediate consumption.

In most cases, some form of plastic may be required to provide a moisture barrier. However, in these cases, given that the structure integrity of the package can be provided a non-plastic (card) layer, the amount of plastic required can be significantly reduced as compared to the prior art. One way of doing this is to provide a plastic coating on an underlying layer. In this case, a separate material would be required to connect the first and second side wall panels. For example, they could be adhered together.

Preferably, the web of flexible material is formed of a laminate of card and a plastic film, the plastic film lining the inside of wedge shaped container. As mentioned above, this requires the use of less plastic than conventional prior art plastic container. Further, the use of a laminate allows the layers to be separated to assist in the subsequent recycling/reuse of the material. The card can be pre-printed with product information. Not only is this more aesthetically pleasing than a plastic film with a sticker, it also eliminates the additional step of adhering a sticker to the pack.

With the laminated arrangement, the first and second side panels could again be connected by an adhesive. However, preferably, one of the first and second side panels of each respective side wall is formed with a flap of unsupported film, which is positioned to overlie the other of the first and second side wall panels in the fold-flat configuration such that the side panels are joined by the flap of unsupported film being bonded to a film on the other of the first and second panels.

With this pack in the fold-flat configuration, the film can simply be bonded, for example, by the application of heat if a heat sealable film is used. This provides a very simple way of creating the joint. Further, the use of a film-to-film joint between the first and second side wall panels can seal the joint in this area.

With this connection, the part of the first or second panel which is bonded to the unsupported film will overlap with the other side wall panel in the erected configuration to provide additional rigidity for the side walls, and particularly to prevent the side wall panels over-rotating about the hinge to prevent them from collapsing inwardly.

Preferably, the edge of the card of the first or second side wall panel adjacent to the flap of unsupported film forms the hinge joint about which the first and second panels can pivot relatively to one another.

Each of the first flanges may be provided exclusively on either the first side wall panel or the second side wall panel extending across the other of the side wall panels. However, preferably, each first flange is formed of a first flange portion on the first side wall panel and a second flange portion on the second side wall panel. When the first and second side wall panels are assembled, the first and second flange portions preferably overlap one another in order to increase the rigidity of the container.

As mentioned above, the container may be loosely closed by a lid. In many circumstances, however, it is desirable to eliminate leakage paths in order to provide a gas tight or gas controlled environment for the product particularly in the case of cheese. In applications for certain types of cheese, it is desirable to have a low level and well controlled flow of gas through the packaging. This is done by using a film with micro pores which are tailored to allow the desired gas flow.

The container of the present invention is particularly useful in such situations as the nature of the packaging reduces the number of seams not least because the junctions between the base, rear wall and side walls are fold lines, rather than joints. This leaves the junctions between the first and second side wall panels and the interface between the lid and the remainder of the container.

Preferably, for each side wall, a cut out is formed in the card across the interface of either the first side wall panel and the first flange or the second side wall panel and the second flange, the cut out being covered with a film such that, when the first flange is folded out, the cut out allows the covering film to seal off a potential leakage path between the first and second panels and also allows the lid to be sealed to the flanges via the covering film.

As set out above, the use of the laminate structure and the out turned flanges allows the lid to be sealed to the flanges. As the flanges are out turned, however, there is a potential leakage path between the flanges at the interface with the lid. Preferably, therefore, the film extends across the junction between the second flange and an adjacent first flange to provide a continuous web of film across and between the flanges Similarly, the film preferably extends across the junction between the lid and an adjacent first flange to provide a continuous web of film across and between the lid and the adjacent first flange.

The continuous webs can be provided by making a cut through the card but not the film just in the region where the flanges meet the corner of the base. The provision of the continuous film in these corner will then ensure that there is a continuous film-to-film surface contact all the way around the rim of the container when the container is closed by a film or a lid having a laminated structure including a complementary film.

Using the above modifications, a container can be created which is devoid of leakage paths which creates a hermetically sealed container which allows the atmosphere within the container to be modified if required. Such a container can then be used in applications where currently a purely plastic container is used. However, with the present invention, the amount of plastic required is greatly reduced for the reasons set out above, while still providing high levels of rigidity for the packaging. The use of the layer of card provides aesthetically pleasing high quality appearance. It also removes the need for a sticker to be applied to the plastic as the product information can printed directly on the card.

Although it is preferable to combine all of the above modifications in order to provide a truly leak free package, there may be situations where limited amounts of gas leakage can be tolerated such that it may be desirable to use some, but not all of the above mentioned modifications to close the leakage paths.

In another aspect, a method for forming a wedge shape container is provided.

Using this method, the container is created from the blank by making only one fold and one with a single bonding step. As such, the container can be produced quickly and economically.

When the container is formed of a laminate of card and plastic film and has the above-mentioned flaps of unsupported film, the method preferably further comprises for each respective sidewall, bonding the flap of unsupported film on one of the first and second side panels to a film on the other of the first and second side panels. Thus, the flap of unsupported film seals to two panels together also provides the means for joining the side panels thereby avoiding the need for an adhesive.

Preferably, the method further comprises the steps of providing a web of card; making a first cut in the card to form some of the feature of the blank, subsequently laminating the card with a plastic film and making a second cut to the laminate to release the laminate from the surrounding web. This provides a way of creating a laminate in which features of the blank can be produced by cutting the card prior to the lamination with the web; thereby avoiding the potential to damage to the film. The second cut is in combination of the card and film layers allowing the finished laminate to be removed from the surrounding web.

The present invention also extends to a method of making a container which can be used beyond the wedge shaped container of the first aspect of the invention. In particular, this can extend to other shapes of container such as a tray like container for receiving wraps and the like or a triangular sandwich container.

EP2057076 discloses a method of making a triangular sandwich container from a folded laminate of card and film. The container has a central fold line running along one side wall, while the opposite side wall and the apex of the container are formed on separate sides of the blank and are bonded together by folding the blank in half and bonding the two halves of the container to create a sealed joint for the opposite sidewall and along the apex of the base.

The second aspect of the present invention provides an improvement of this method which allows for different configurations of container to be formed.

According a further aspect, there is provided a method of forming a container in a fold flat configuration.

The bonding between the two halves of the container along a side wall takes place between a flap of film which is not supported with underlying card. This creates a free edge of card adjacent to the flap of film thereby creating a region along the side wall about which the container can readily pivot from the fold-flat configuration. In EP2057076, the joint along the side wall is between two laminated regions rather than one laminated region and one unsupported film region so that, in order to be erected from the fold-flat configuration, the card must be folded in this region.

The second aspect of the invention can be used in a blank with a single flap of film along one side wall. However, preferably, the container has a pair of sidewalls extending away from a base, and a flap of film without underlying card is provided running along each of the sidewalls.

This allows greater flexibility in the containers which can be formed as the two side walls can now be hinged around the free edge. The containers, which are formed, are effectively lined with a continuous sheet of film, which is folded in half and is sealed by a film-to-film joint along the sidewalls. This provides a container which can easily be made to be free of leakage paths.

The folded part and second part may have the same shape and size as in EP2057076. However, preferably, the first and second parts of the container have different shapes and/or sizes. This asymmetry allows much greater flexibility in the containers, which can be produced. In particular, the asymmetric folding allows the sidewalls to be formed of two side wall panels of different shapes and/or sizes also for a lid to be integrated into the container.

Preferably, in the first cutting stage, at least one flange cut is made in the card at location between adjacent flanges in the finished container and, in subsequent cutting stages, the flange is cut out while the film remains uncut across the flange cut. This provides a continuous web of film, which runs across adjacent flanges. If the container is sealed to a lid or a film, this provides an unbroken film surface across and between adjacent flanges.

Score lines and/or perforations may be formed for the container, and this can be done in the second cutting stage, but is preferably in the first cutting stage as this can be done without risk of damaging the film. Preferably, in the first cutting stage, at least one window is formed in the card. This allows visibility of the content of the pack. Doing this in the first cutting stage, again avoids the risk of damaging the film.

In the folding stage, a step of folding the laminate may comprise folding the entire laminate web. Alternatively, the folding stage comprises folding the container and not the surrounding laminate. In order to do this, the outline cut for the folded part must be fully formed prior to the folding stage to allow just the container to be folded without the surrounding laminate web.

In the folding stage, the laminate may be folded about a single fold line to produce a first type of container. In order to produce a different type of container, in the folding stage, the laminate is folded about a first fold line in one direction and two additional fold lines on either side of the first fold line in an opposite direction to create a base region bounded by the two additional fold lines with the first fold line along its center.

BRIEF DESCRIPTION OF THE DRAWINGS

An example of a container and method in accordance with the present invention will now be described with reference to the accompanying drawings, in which.

DETAILED DESCRIPTION OF THE PREFERRED EMBODIMENT(S)

Figure 1:
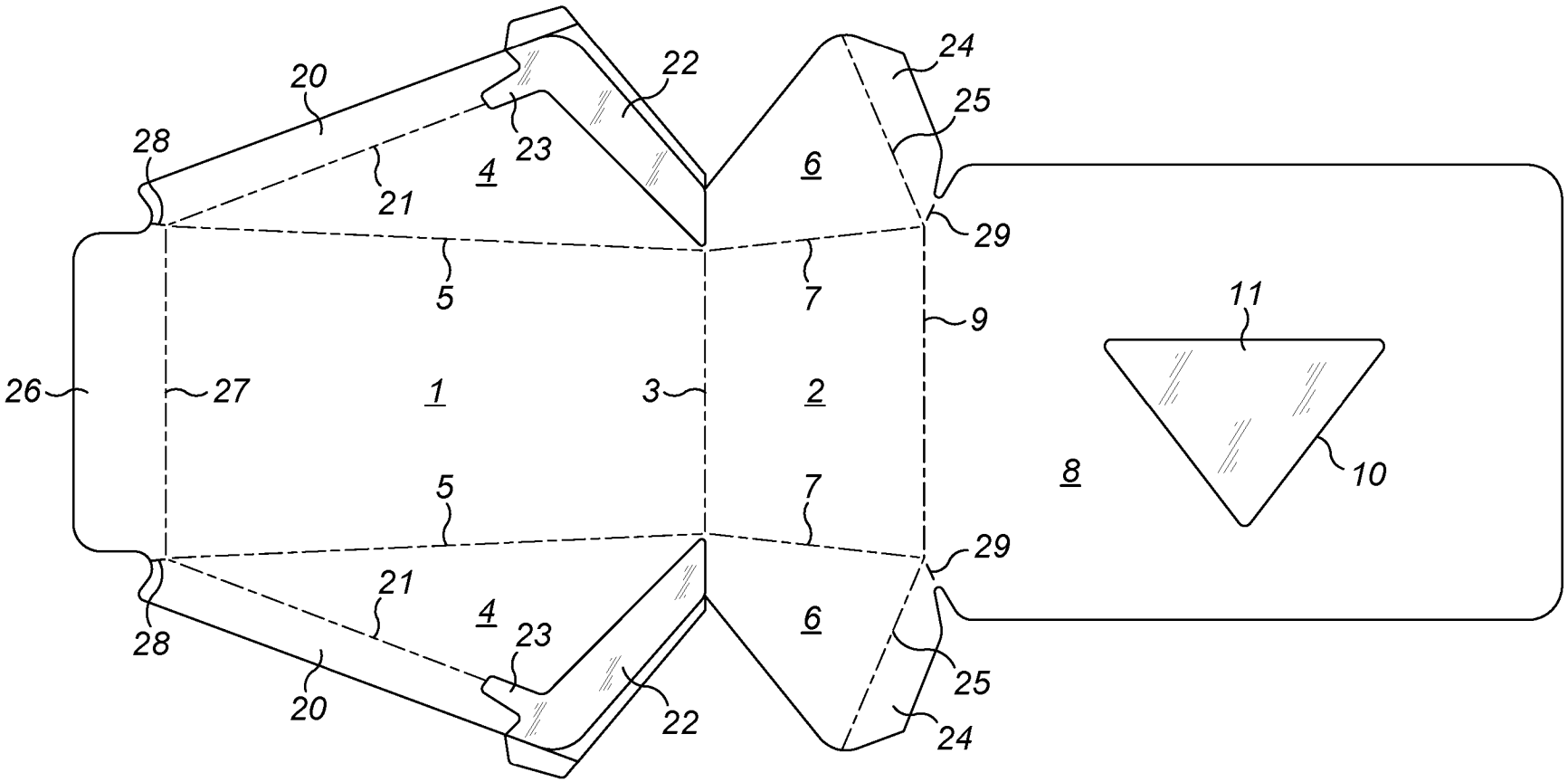
FIG. 1 is a plan view of the blank.

The container of the present invention is formed from a blank as illustrated in FIG. 1. The blank comprises a laminate of card and film as described in greater detail below. In FIG. 1, the film entirely covers the card. However, there are areas shown shaded when the card is absent and the only layer is film as described below. The film extends fully across the entirety of the lower face of the blank shown in FIG. 1 such that all of the card is covered with a film. Thus, the peripheral outer edge of the film is the periphery of the entire blank shown in FIG. 1 including the unsupported film areas. In FIG. 1, the blank is depicted with the card layer uppermost and this will subsequently be referred to as the top face.

The blank of FIG. 1 comprises a base 1 to which a rear wall 2 is connected via a first fold line 3. The fold line 3 is shown as continuous score line in the top face of the blank which does not pass fully through the card.

In common with all of the other fold lines below, whilst a particular type of line of weakness is illustrated, it should be understood that any type of line of weakness may be formed in each case whether this be a continuous groove or perforation which may or may not pass through the full thickness of the card. Further, the line of weakness can be formed on either side of the card.

First side wall panels 4 are connected one either side of the base 1 via second fold lines 5 formed as a score line on the top face.

Second side wall panels 6 are connected to opposite sides of the rear wall 2 via third fold lines 7 formed as perforations. These above mentioned parts form the essence of the finished container as described below.

Optionally lid 8 is attached to the rear wall 2 via a fourth fold line 9. It will be appreciated, however, that the lid 8 could be formed at a different position in the blank, for example at the opposite end of the base 1 or even attached to one of the flanges described below. An opening 10 is cut in the card to form a window of film 11 which can be of any size and shape to allow the contents of the container to be viewed. More than one window can be formed. Windows can also similarly be formed on the base or side wall panels 4, 6.

Each of the first side wall panels 4 has a generally triangular configuration, the longest side of which extends along one side of the base 1. At an opposite side of the first side wall panel 4 is a first flange portion 20 which is foldable outwardly at the fifth fold line 21. The third edge of the triangle is formed with an unsupported flap of film 22.

A cut out portion 23 is cut in the card at the junction between the first side wall panel 4 and first flange portion 20 so as to span the fifth fold line 21. In this cut out portion, the film is present effectively providing an extension of the flap 22.

The second side wall panel 6 is provided with a second flange portion 24 which can be folded outwardly along the sixth fold line 25.

Although the flap of film 22 and cut out portion 23 are shown on the first side wall panel 4, they could equally be provided on the second side wall panel 6 at the junction with the second flange portion 24. In this case, the first side wall panel 4 would simply have card covering the portion depicted as the unsupported flap of film.

A further flange 26 is provided at the end of the base 1 opposite to the rear wall 2 which is foldable along the seventh fold line 27.

The card at the junction between each first flange panel 20 and the further flange 26 has a cut 28 which extend through the card, but not through the film. A similar cut 29 in just the card is provided at the interface between the second flange portion 24 and the lid 8.

In order to create the receptacle from the blank shown in FIG. 1, it is simply necessary to fold the blank about the first fold line 3. With reference to FIG. 1, this fold will require movement into the plane of the paper such that sides with the film come into contact with one another. In this position, it is simply a matter of applying heat to the region in which the flap of film 22 comes into contact with the film on the face of the second side wall panel 6 thereby bonding the container together in that area.

That single fold and bonding operation is sufficient to complete the blank in the fold-flat configuration.

In that form, the container may then be transported to a separate site for filling.

Figure 2:
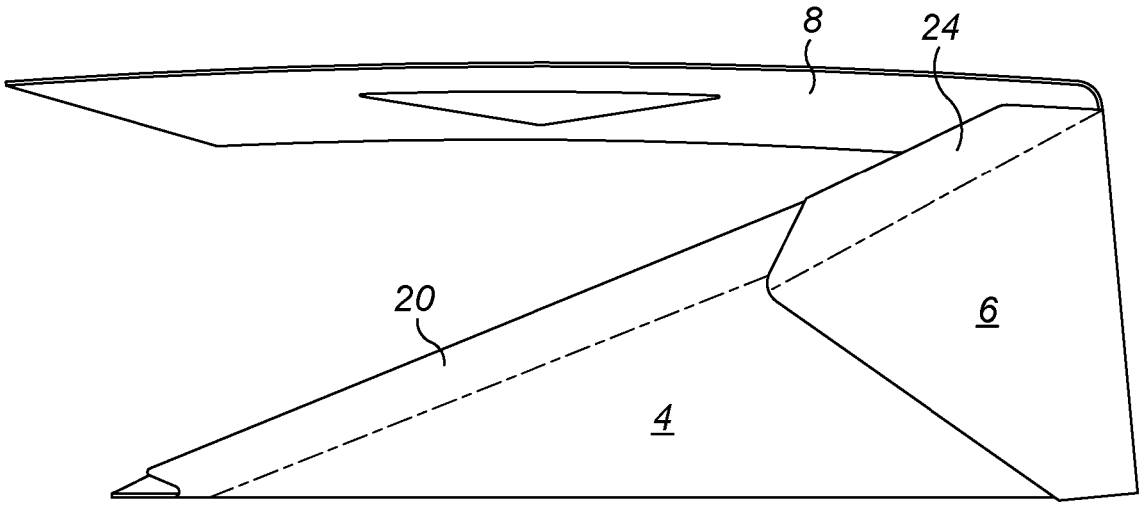
FIG. 2 is a perspective view form one side showing the near fully erect container with the lid open.
Figure 3:
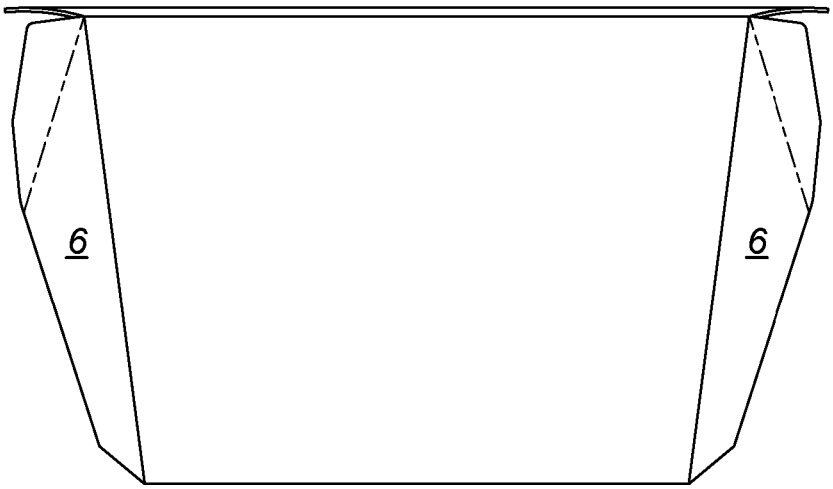
FIG. 3 is a perspective view of the nearly fully erected container form the rear erected container.

A stack of blanks in the fold-flat configuration are loaded into a packaging machine. As each blank in turn is loaded onto the production line, a suction cup is applied to the lid 8 and/or rear wall 2 to pull these away from the base 1. Doing this causes the side walls formed of the first 4 and second 6 panels to be pulled inwardly in order to form the erect side walls 30. This is shown in FIGS. 2 and 3 which show the container in its nearly fully erect configuration. This container is placed in a corresponding shaped die in which the flanges formed of the first flange portion 20 and second flange portion 24 are out turned. It is not necessary to fold out the further flange portion 26 in a separate operation as this stays very close to the plane of the base 1.

At the junction between the first side wall panel 4 and second side wall panel 6, the film in the cut out portion 23 has folded back onto the film on the unsupported flap 22 and extends from the top of the side wall panel 4 partially across the top of the underlying second flange portion 24.

A portion of the second side wall panel 6 which is bonded to the flap of film 22 now overlaps the edge of the side wall portion 4 adjacent to the flap of film 22 providing a double thickness of card in this region which resists any inward deflection of the side walls.

With the container in this configuration, it is now filled with an item such as a wedge of cheese.

It then moves a further processing station where the lid 8 is folded down and heat is applied to the areas where the flanges 20, 24 and 26 meet the lid 8 in order to seal the container.

Most of wedge shaped container is lined with a single unbroken layer of film which will not create any leak paths.

At the junction between the first 4 and second 6 side wall panels, there is a film to film contact between the flap of film 22 and the corresponding film on the flange 6 which provides a gas tight seal for this joint.

There is, however, a step change in thickness equal to the thickness of the laminate where the edge of the side wall panel 4 overlies the second side wall panel 6. This step, however, runs out below the flange 20, 24 so that there is no step at the interface with the lid. When the lid is sealed into place, in this region there are effectively three layers of film sealed directed together namely the film on the first flange portion 24 which is overlaid by the film in the cut out portion 23 and then the film on the underside of the lid. This provides a hermetic seal at that junction. The cut out portion also has the effect of ensuring that a similar step change which occurs where the first flange portion 20 overlies the second flange portion 24 again does not extend to the in-side edge of the flange portions such that the part of the film in the cut out 23 which ends up on top of the second flange portion 24 closes off a leakage path at this junction on the flange.

As the lid 8 is pressed onto the flanges, it pushes the flanges out into their final position. This has the effect of slightly separating the flanges at the cuts 28, 29 and slightly stretching the underlying film. This provides a continuous web of film from the first flange portion 20 across the gap and then across the further flange 26. This provides continuous film to film contact between the film on the lid and the film on the flanges thereby eliminating any leakage paths. A similar effect occurs in the vicinity of the cut 29 whether there is continuous film on the second flange portion 24 across the gap and onto the lid 8 so that there is again film to film surface contact between the lid and the second flange portion 24.

Taking all of these measures together allows the formation of a gas leak-free container which is formed from a folded blank of a laminate of card and film which has a very simply assembly and filling method.

By appropriate choice of film, the container can be hermetically sealed if necessary. Alternatively, a film can be used with micro pores to allow controlled gas flow through the pack.

The manner in which the blank is formed will now be described with reference to FIGS. 4A to 4E which show various actions carried out on a web of material which is fed from left to right through a cutting machine. As will be apparent from this description, the blank is formed ion the fold flat configuration described above, rather than the fully flat blank shown in FIG. 1.

Figure 4A:
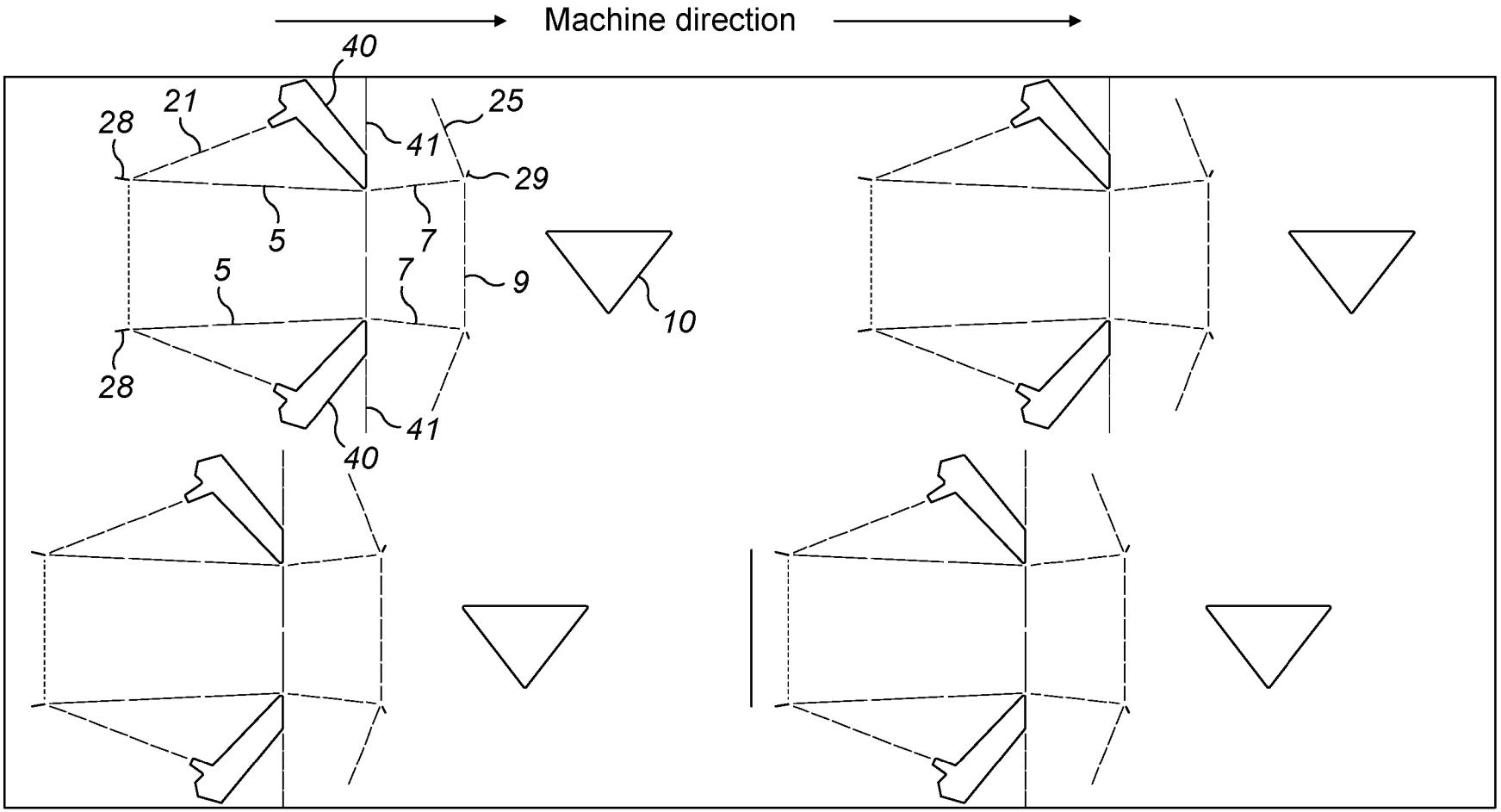
FIGS. 4A-4E are plan views showing successive stages of forming four blanks.

FIG. 4A shows the first cutting stage which takes place on just the card layer before it is laminated with the film.

At this stage, a number of the fold/score lines previously described are formed as shown in FIG. 4A. A through cut is made to provide the opening 10 and further through cuts 40 are made to create openings which will ultimately be covered with the flap of film 22. The cuts 28, 29 are also formed at this time.

A through cut 41 is also created in alignment with the fold line 3 for reasons described below.

Figure 4B:
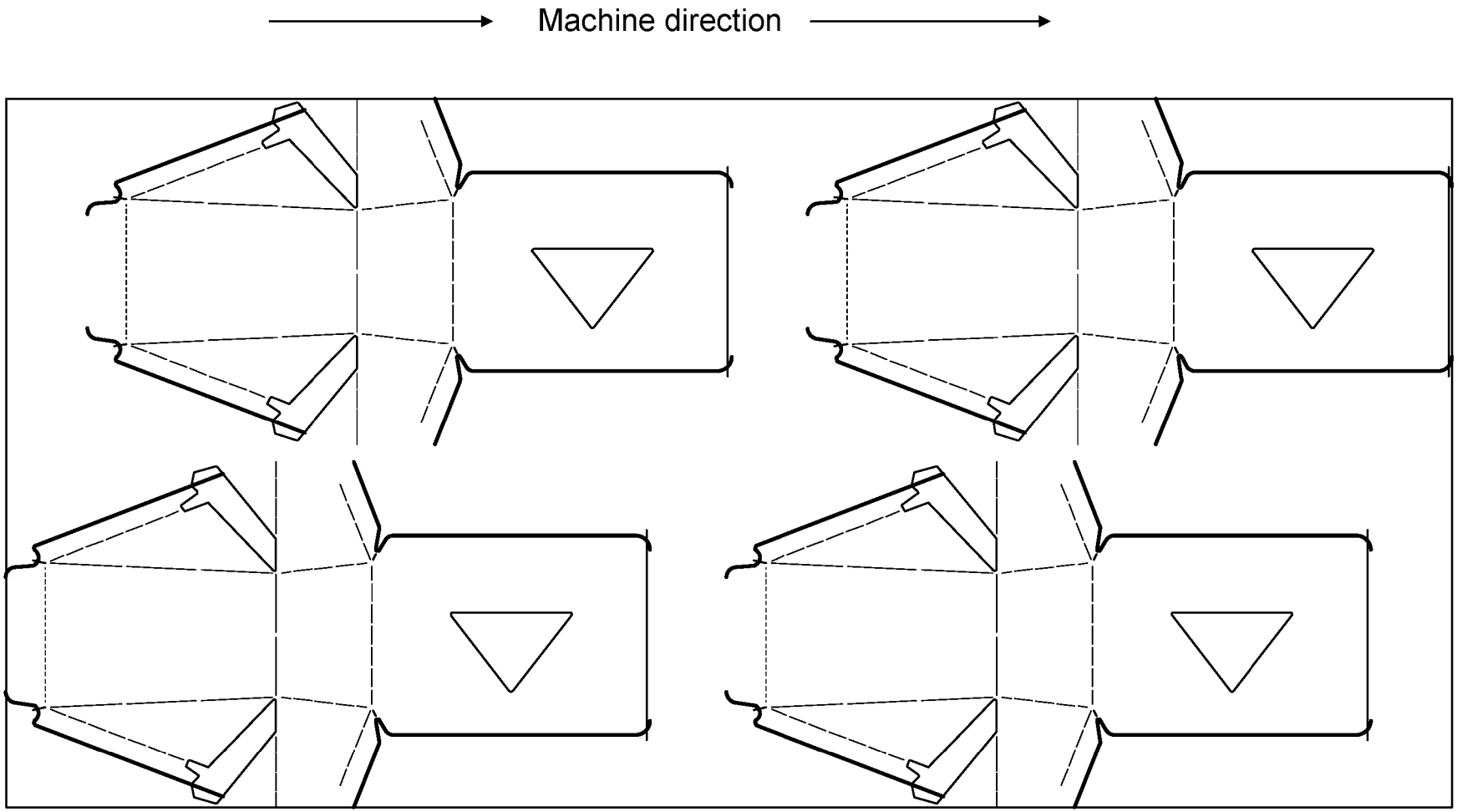

The web of card is then laminated with the film before proceeding to the second cutting stage where an outline cut is made as depicted by the bold lines in FIG. 4B. This represents a through cut extended fully through the laminate and surrounds the majority of the blank leaving it connected to the surrounding web of material at either end of the sheet and the outer peripheries of the side wall panels 6.

Figure 4C:
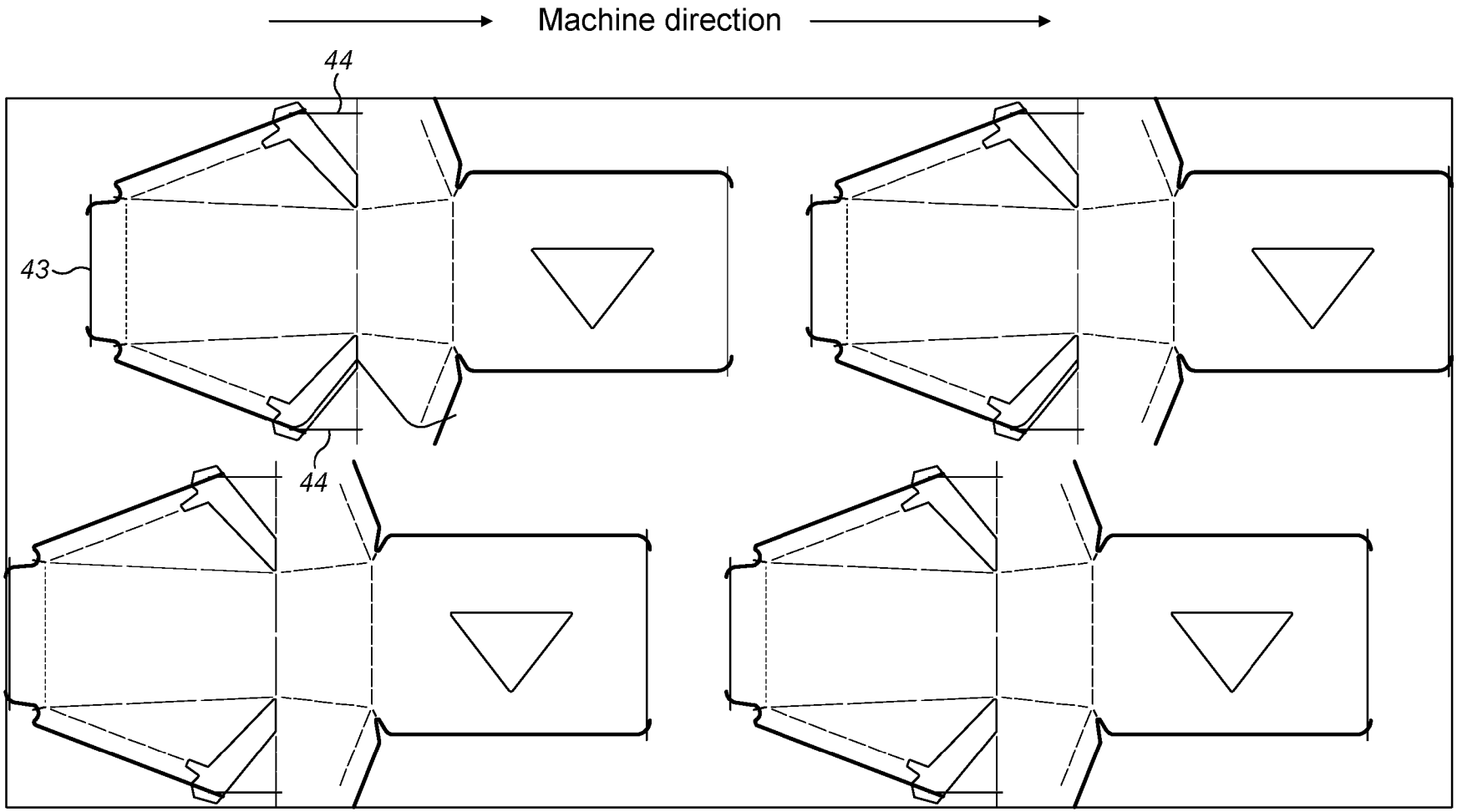

In the third cutting stage depicted in FIG. 4C, a cut 43 is made at the outer edge of the tab. Two further cuts 44 are made which do not form part of the outline of the blank, but connect with the cut line 41 to ensure that all of the blank to the left of cutline 41 is separated from the surrounding material.

Figure 4D:
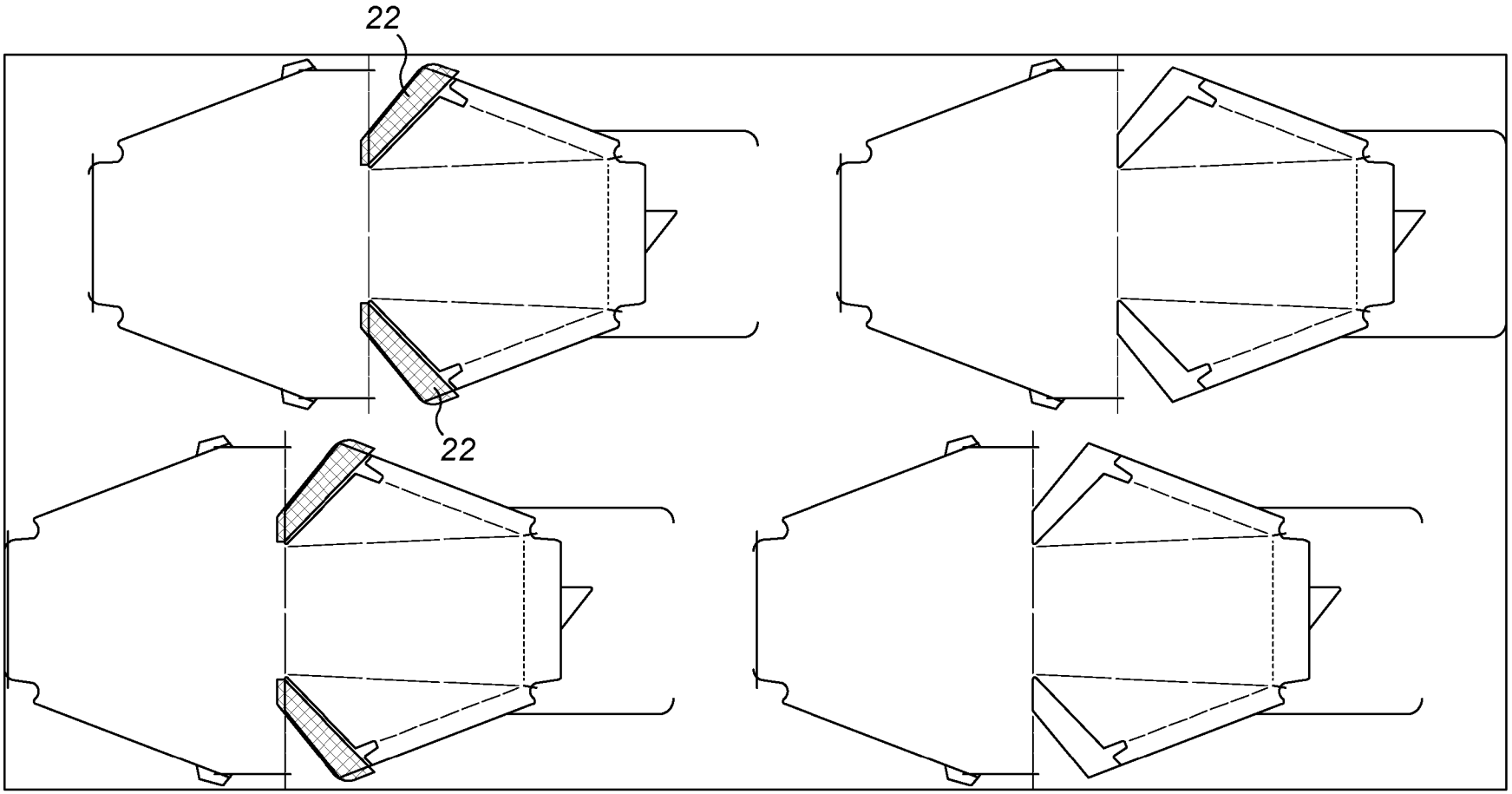

In FIG. 4D, a folding stage takes place such that all of the material to the left of the cutline 41 is folded over onto the opposite side of the blank such that the film 22 overlies part of the side-wall panel 6. The film 22 is heated as described above to bond the two parts together in this region.

Figure 4E:
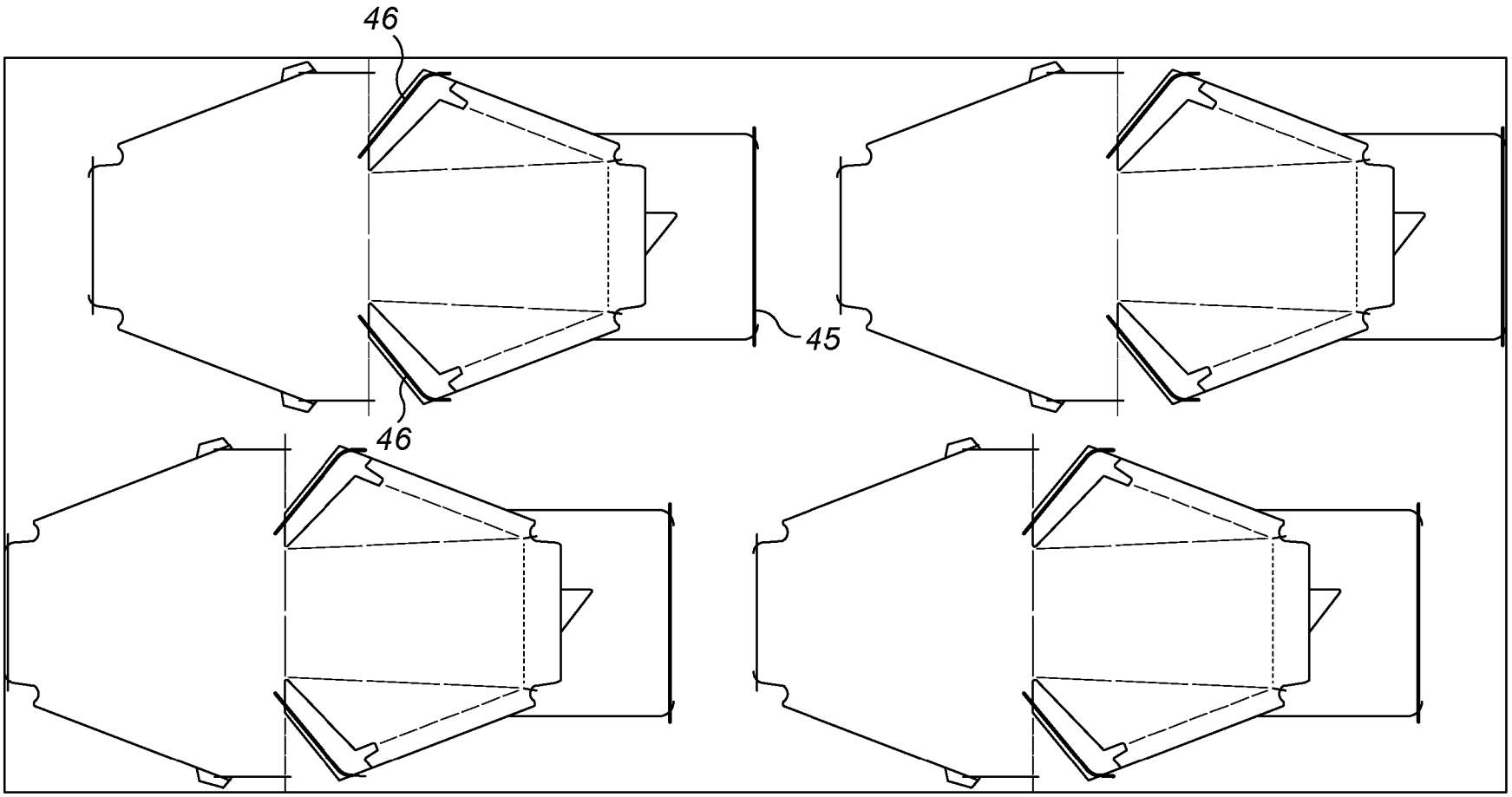

In the final stage shown in FIG. 4E, the folded blank is severed from the web by a cut 45 at the right hand end of the lid and two further cuts 46 which cut away the additional material inside the cut line 41, 44 to create the final shape of the side wall panel 6. In this form, the blank is now free of the web and is in the fold flat configuration as depicted in FIG. 2.

Particular aspects of the disclosure are described below in the following sets of interrelated Clauses:

Clause 1. A wedge shaped container formed from a folded web of flexible material, the container comprising:

a base, a rear wall connected at a first edge of the base via a first fold line, and a pair of upstanding side walls, one on each side of the base, each side wall decreasing in height from the rear wall to the opposite end of the base such that in an erected configuration the base, rear wall and side walls form a wedge shape;

each side wall being formed of a first side wall panel extending along and connected at an edge of the base via a second fold line transverse to the first fold line; and a second side wall panel extending along and connected at an edge of the rear wall via a third fold line transverse to the first fold line;

wherein the side wall panels of a respective side wall are connected together by a hinge joint, so that, from a fold-flat configuration, in which the rear wall overlies the base, folding of the rear wall about the first fold line away from the base causes the respective side wall panels to be folded inwardly about the second and third fold lines into the erected configuration in which the first and second side wall panels form the upstanding side walls to form the wedge shaped container.

Clause 2. A container according to Clause 1, further comprising an integral lid to close the container.

Clause 3. A container according to Clause 2, wherein the lid is connected at a fourth fold line at an edge of the rear wall opposite to the first fold line, the lid being foldable about the fourth fold line to close the wedge shaped container.

Clause 4. A container according to any preceding Clause, wherein the container has first out turned flanges along the edges of the respective side walls opposite to the base and a second out turned flange at the opposite end of the base.

Clause 5. A container according to Clauses 2 and 4, wherein the lid is bondable to the first and second flanges to close the container.

Clause 6. A container according to any preceding Clause, wherein the web of flexible material is formed of a laminate of card and a plastic film, the plastic film lining the inside of wedge shaped container.

Clause 7. A container according to Clause 6, wherein one of the first and second side panels of each respective side wall is formed with a flap of unsupported film, which is positioned to overlie the other of the first and second side wall panels in the fold-flat configuration such that the side panels are joined by the flap of unsupported film being bonded to a film on the other of the first and second panels.

Clause 8. A container according to Clause 7 wherein, the edge of the card of the first or second side wall panel adjacent to the flap of unsupported film forms the hinge joint about which the first and second panels can pivot relatively to one another.

Clause 9. A container according to Clause 4, wherein each first flange is formed of a first flange portion on the first side wall panel and a second flange portion on the second side wall panel.

Clause 10. A container according to Clauses 2, 6 and 9, wherein for each side wall, a cut out is formed in the card across the interface of either the first side wall panel and the first flange or the second side wall panel and the second flange, the cut out being covered with a film such that, when the first flange is folded out, the cut out allows the covering film to seal off a potential leakage path between the first and second side wall panels and also allows the lid to be sealed to the flanges via the covering film.

Clause 11. A container according to Clauses 6 and 9, wherein the film extends across the junction between the second flange and an adjacent first flange to provide a continuous web of film across and between the flanges.

Clause 12. A container according to Clauses 6 and 9, wherein the film extends across the junction between the lid and an adjacent first flange to provide a continuous web of film across and between the lid and the adjacent first flange.

Clause 13. A container according to Clause 11 or 12, wherein the continuous web is provided by a cut through the card but not the film in the region where the flanges meet the corner of the base.

Clause 14. A method of forming a wedge shaped container according to any one of the preceding Clauses, the method comprising forming a blank from a web of flexible material, the blank comprising the base, rear wall and sidewall panels;

folding the blank about the first fold line to position the respective first and second sidewall panels of each side wall on top of one another; and bonding the respective first and second side panels to one another to form the hinge joint.

Clause 15. A method according to Clause 14 of making a container according to Clauses 6 and 7, the method comprising, for each respective sidewall, bonding the flap of unsupported film on one of the first and second side panels to a film on the other of the first and second side panels.

Clause 16. A method according to Clause 14 or 15 of making a container according to Clause 6, the method further comprising the steps of providing a web of card;

making a first cut in the card to form some of the features of the blank;

subsequently laminating the card with a plastic film; and making a second cut to the laminate to release the laminate from the surrounding web.

Clause 17. A method of forming a container in a fold flat configuration, the method comprising the following steps;

providing a web of card;

in a first cutting stage, making a number of through cuts to form a number of features of the container in the web of card;

laminating the web of card with a film to form a laminate web;

in a second cutting stage, making second cuts through the laminate web;

the first and second cutting stages making cuts which are offset so as to leave at least one flap of film without underlying card in a region running along a side wall of the container;

in a folding stage folding the laminate so that the film of a first folded part is folded onto the film of a second part such that the flap of film is positioned adjacent to a part of the film of the laminate of the adjacent part of the container;

heating the film in the vicinity of the flap of film to bond it to the film of the laminate on the other part;

and, in a third cutting stage, making an outline cut around the folded the container to cut the container from the web.

Clause 18. A method according to Clause 17, wherein the container has a pair of sidewalls extending away from a base, and a flap of film without underlying card is provided running along each of the sidewalls.

Clause 19. A method according to Clause 17 or Clause 18, wherein the first and second parts of the container have different shapes and/or sizes.

Clause 20. A method according to any of Clauses 17 to 19, wherein in the first cutting stage, at least one flange cut is made in the card at location between adjacent flanges in the finished container and, in subsequent cutting stages, the flange is cut out while the film remains uncut across the flange cut.

Clause 21. A method according to any of Clauses 19 to 20, wherein score lines and/or perforations are formed in the first cutting stage.

Clause 22. A method according to any of Clauses 17 to 21, wherein in the first cutting stage, at least one window is formed in the card.

Clause 23. A method according to any of Clauses 17 to 22, wherein the folding stage comprises folding the container and not the surrounding laminate.

Clause 24. A method according to any of Clauses 17 to 23, wherein the laminate is folded about a single fold line.

Clause 25. A method according to any of Clauses 17 to 23, wherein in the folding stage, the laminate is folded about a first fold line in one direction and two additional fold lines on either side of the first fold line in an opposite direction to create a base region bounded by the two additional fold lines with the first fold line along its center.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof

What is claimed is:

1. A wedge shaped container formed from a folded web of flexible material, the container comprising:

a base, a rear wall connected at a first edge of the base via a first fold line, and a pair of upstanding side walls, one on each side of the base, each side wall decreasing in height from the rear wall to the opposite end of the base such that in an erected configuration the base, rear wall and side walls form a wedge shape;

each side wall being formed of a first side wall panel extending along and connected at an edge of the base via a second fold line transverse to the first fold line; and a second side wall panel extending along and connected at an edge of the rear wall via a third fold line transverse to the first fold line;

wherein the side wall panels of a respective side wall are connected together by a hinge joint, so that, from a fold-flat configuration, in which the rear wall overlies the base, folding of the rear wall about the first fold line away from the base causes the respective side wall panels to be folded inwardly about the second and third fold lines into the erected configuration in which the first and second side wall panels form the upstanding side walls to form the wedge shaped container.

2. A container according to claim 1, further comprising an integral lid to close the container.

3. A container according to claim 2, wherein the lid is connected at a fourth fold line at an edge of the rear wall opposite to the first fold line, the lid being foldable about the fourth fold line to close the wedge shaped container.

4. A container according to claim 1, wherein the container has first out turned flanges along the edges of the respective side walls opposite to the base and a second out turned flange at the opposite end of the base.

5. A container according to claim 4, wherein each first flange is formed of a first flange portion on the first side wall panel and a second flange portion on the second side wall panel.

6. A container according to claim 5, wherein the lid is bondable to the first and second flanges to close the container.

7. A container according to claim 1, wherein the web of flexible material is formed of a laminate of card and a plastic film, the plastic film lining an inside of the wedge shaped container.

8. A container according to claim 7, wherein one of the first and second side panels of each respective side wall is formed with a flap of unsupported film, which is positioned to overlie the other of the first and second side wall panels in the fold-flat configuration such that the side panels are joined by the flap of unsupported film being bonded to a film on the other of the first and second panels.

9. A container according to claim 8, wherein, an edge of the card of the first or second side wall panel adjacent to the flap of unsupported film forms the hinge joint about which the first and second panels can pivot relatively to one another.

10. A container according to claim 7, wherein for each side wall, a cut out is formed in the card across an interface of either the first side wall panel and the first flange or the second side wall panel and the second flange, the cut out being covered with a film such that, when the first flange is folded out, the cut out allows the covering film to seal off a potential leakage path between the first and second side wall panels and also allows the lid to be sealed to the flanges via the covering film.

11. A container according to claim 7, wherein the film extends across the junction between the second flange and an adjacent first flange to provide a continuous web of film across and between the flanges.

12. A container according to claim 11, wherein the continuous web is provided by a cut through the card but not the film in the region where the flanges meet the corner of the base.

13. A container according to claim 7, wherein the film extends across the junction between the lid and an adjacent first flange to provide a continuous web of film across and between the lid and the adjacent first flange.

* * * * *